US011041487B2

(12) United States Patent
Gray et al.

(10) Patent No.: US 11,041,487 B2
(45) Date of Patent: Jun. 22, 2021

(54) WASTEWATER SUMP ASSEMBLY

(71) Applicant: Franklin Electric Company, Inc., Bluffton, IN (US)

(72) Inventors: Steven C. Gray, Bluffton, IN (US); Robert D. Chase, Bluffton, IN (US); Larry D. Talbott, Bluffton, IN (US); Scott E. Stayton, Bluffton, IN (US); K. Lynn Doughty, Bluffton, IN (US)

(73) Assignee: FRANKLIN ELECTRIC COMPANY, INC., Bluffton, IN (US)

( * ) Notice: Subject to any disclaimer, the term of this patent is extended or adjusted under 35 U.S.C. 154(b) by 850 days.

(21) Appl. No.: 13/842,954

(22) Filed: Mar. 15, 2013

(65) Prior Publication Data

US 2014/0271126 A1 Sep. 18, 2014

(51) Int. Cl.
*F04B 23/02* (2006.01)
*F04B 15/02* (2006.01)

(52) U.S. Cl.
CPC ..... *F04B 23/021* (2013.01); *F04B 15/02* (2013.01)

(58) Field of Classification Search
CPC ..... F04B 23/021; F04B 23/02; F04B 15/02; E03C 1/22; E03F 5/0402; E03F 5/22; E03F 5/0407; E03F 5/0408; E03F 5/0409; E03F 5/042; E03F 5/0401; F04D 13/086
See application file for complete search history.

(56) References Cited

U.S. PATENT DOCUMENTS

| | | | |
|---|---|---|---|
| 553,794 | A | 1/1896 | Thatcher |
| 1,498,245 | A | 6/1924 | Le May |
| 1,947,140 | A | 2/1934 | Rollason |
| 2,240,880 | A | 5/1941 | Bennett |

(Continued)

FOREIGN PATENT DOCUMENTS

| | | |
|---|---|---|
| CA | 719 464 | 10/1965 |
| CA | 766 515 | 9/1967 |

(Continued)

OTHER PUBLICATIONS

Dab, Polypump.Com. "Fekabox 100", website—http://bigspace.celerity.co.uk/polypump/dab_fekabox100_pdf, 2007.

(Continued)

*Primary Examiner* — Bryan M Lettman
(74) *Attorney, Agent, or Firm* — Faegre Drinker Biddle & Reath LLP

(57) ABSTRACT

A wastewater sump assembly for receiving and disposing of undesired fluid and, in some cases, solid waste is disclosed. A sump basin formed from a base, an upstanding wall and a top which are all defined from a single, integral, monolithic material may be employed. The top of the monolithic basin includes a pump access aperture sized to allow passage of a submersible pump. Pipe stubs are provided in a recessed area of the top to allow for easy connection to outlet and vent piping. Interchangeable switches of differing types, e.g. a diaphragm switch and a float switch can be utilized with the sump basin. Certain switch subassemblies include a handle to facilitate easy removal. The handle may also be utilized (Continued)

to hold a cord seal in place atop the sump. A diaphragm switch in accordance with the present disclosure may be positioned externally of the sump.

25 Claims, 7 Drawing Sheets

(56) References Cited

U.S. PATENT DOCUMENTS

| | | | | |
|---|---|---|---|---|
| 2,254,168 | A | 8/1941 | Dale | |
| 2,488,506 | A | 11/1949 | Bernhardt | |
| 2,531,752 | A | 11/1950 | Thomas | |
| 2,701,529 | A | 2/1955 | Finzel | |
| 2,834,845 | A | 5/1958 | Nielsen | |
| 2,922,854 | A | 1/1960 | Nielsen | |
| 2,935,029 | A | 5/1960 | Miles | |
| 3,162,737 | A | 12/1964 | Tutthill | |
| 3,198,125 | A | 8/1965 | Yuza et al. | |
| 3,256,822 | A | 6/1966 | McHenry | |
| 3,307,000 | A | 2/1967 | Ekey | |
| 3,373,896 | A | 3/1968 | Davis | |
| 3,474,843 | A | 10/1969 | Maris | |
| 3,656,866 | A | 4/1972 | Hine, Jr. et al. | |
| 3,667,692 | A | 6/1972 | Grace | |
| 3,726,606 | A | 4/1973 | Peters | |
| 3,784,772 | A * | 1/1974 | Nelson | H01H 35/34 200/83 B |
| 3,794,789 | A | 2/1974 | Bynum | |
| 3,916,130 | A | 10/1975 | Cade | |
| 3,954,178 | A | 5/1976 | Mason, Jr. | |
| 3,992,130 | A | 11/1976 | Childress | |
| 4,228,427 | A | 10/1980 | Niedermeyer | |
| 4,275,815 | A | 6/1981 | Davis | |
| 4,344,543 | A | 8/1982 | Hoffman | |
| 4,513,875 | A | 4/1985 | Kuehn, Sr. | |
| 4,627,537 | A | 12/1986 | Rogers | |
| 4,832,227 | A | 5/1989 | Hoffman | |
| 4,890,425 | A | 1/1990 | Mamula | |
| 5,100,298 | A | 3/1992 | Shibata et al. | |
| 5,217,142 | A | 6/1993 | Schutz | |
| 5,226,558 | A | 7/1993 | Whitney et al. | |
| 5,324,171 | A | 6/1994 | Cook | |
| 5,361,906 | A * | 11/1994 | Sterett | B65D 11/06 206/509 |
| 5,383,558 | A | 1/1995 | Wilkinson et al. | |
| 5,535,910 | A | 7/1996 | Cassel | |
| 5,669,526 | A | 9/1997 | Keyfauver | |
| 5,799,792 | A | 9/1998 | Abrums | |
| 5,886,266 | A | 3/1999 | Stiller et al. | |
| 5,924,846 | A | 7/1999 | Arnold, Jr. et al. | |
| 6,059,208 | A * | 5/2000 | Struthers | E03F 5/26 241/285.1 |
| 6,164,315 | A * | 12/2000 | Haslock | E03F 5/22 137/271 |
| 6,273,291 | B1 | 8/2001 | Conti | |
| 6,276,093 | B1 | 8/2001 | Janesky | |
| 6,305,410 | B1 | 10/2001 | Cook et al. | |
| 6,322,326 | B1 | 11/2001 | Davis et al. | |
| 6,348,657 | B1 | 2/2002 | Haslock et al. | |
| 6,375,430 | B1 | 4/2002 | Eckert et al. | |
| 6,420,668 | B1 | 7/2002 | Lee | |
| 6,430,757 | B1 | 8/2002 | Pohler | |
| 6,464,531 | B2 | 10/2002 | Eckert et al. | |
| 6,555,754 | B2 | 4/2003 | Gilmour | |
| 6,772,782 | B2 | 8/2004 | Bogan et al. | |
| D500,770 | S | 1/2005 | Pohler | |
| 6,854,479 | B2 | 2/2005 | Harwood | |
| 6,867,383 | B1 | 3/2005 | Currier | |
| 6,953,302 | B1 | 10/2005 | Kochling | |
| D523,517 | S | 6/2006 | Flick | |
| 7,100,632 | B2 | 9/2006 | Harwood | |
| 7,264,449 | B1 | 9/2007 | Hamed et al. | |
| 7,520,736 | B2 * | 4/2009 | Pohler | E03F 5/22 174/151 |
| 7,563,082 | B2 | 7/2009 | Pohler | |
| 7,578,657 | B2 | 8/2009 | Kowalak et al. | |
| 7,712,259 | B1 | 5/2010 | Pettesch | |
| 7,832,586 | B2 | 11/2010 | Vovan | |
| 7,855,345 | B2 | 12/2010 | Stevens et al. | |
| 8,523,532 | B1 * | 9/2013 | Pohler | E03F 5/22 220/735 |
| 2004/0231247 | A1 | 11/2004 | Thachenkery | |
| 2005/0034383 | A1 | 2/2005 | Allen | |
| 2006/0272203 | A1 | 12/2006 | Weber | |
| 2007/0284276 | A1 | 12/2007 | Luttik et al. | |
| 2008/0000795 | A1 | 1/2008 | Deakin et al. | |
| 2009/0129940 | A1 | 5/2009 | Stevens et al. | |
| 2010/0236966 | A1 | 9/2010 | Luttik et al. | |
| 2012/0085688 | A1 | 4/2012 | Schmidt et al. | |
| 2012/0107137 | A1 * | 5/2012 | Early | E03F 5/22 417/1 |

FOREIGN PATENT DOCUMENTS

| | | |
|---|---|---|
| CA | 785 887 | 5/1968 |
| CA | 945 417 | 4/1974 |
| CA | 1034676 | 7/1978 |
| CA | 1052458 | 4/1979 |
| CA | 2 344 083 | 4/2001 |
| CA | 2 162 371 | 7/2001 |
| EP | 0 619 431 A1 | 10/1994 |
| EP | 1 471 037 | 10/2004 |

OTHER PUBLICATIONS

Dab, Polypump.Com "Fekabox 200", website—http://bigspace.celerity.co.uk/polypump/dab_fekabox200_pdf, 2007.

Dab, Polypump.Com "Fekabox 280", website—http://bigspace.celerity.co.uk/polypump/dab_fekabox280_pdf, 2007.

Franklin Electric Co., Inc., "Little Giant 14S-CIM, 16S-CIM, 14EH-CIM and 16EH-CIM", http://littlegiant.com/media/131347/993302.pdf, Instruction Manual, May 4, 2010.

Franklin Electric Co., Inc., "Submersible Effluent & Sewage Pumps WS Series", http://littlegiant.com/media/131392/200499_WS.pdf, Aug. 24, 2010.

Franklin Electric Co., Inc., "Little Giant Sewage Accessories", Manual, http://littlegiant.com/media/131661/998127.pdf, Dec. 2007.

Franklin Electric Co., Inc., "Little Giant Sewage Pump Replacement Parts Manual", http://littlegiant.com/media/131717/993467.pdf, Mar. 3, 2009.

Franklin Electric Co., Inc., "Little Giant Sewage Accessories & Instructions for Typical Installaction", http://littlegiant.com/media/131732/998149.pdf, Dec. 2007.

Crane Pumps and Systems, "Packaged Sewage Systems", http://www.cranepumps.com/downloadables/brochures/BPPPKGSYS.pdf, 2015.

Jackel, Sump Basin Cover, Part No. SF60914-S, http://www.jackelinc.com/pdf/SF60914-S%20Product%20Sheet.pdf, Jan. 2014.

Jackel, "Sump Basin Cover, Part No. SF60915-P", http://www.jackelinc.com/pdf/SF60915-P%20Product%20Sheet.pdf, Jan. 2014.

Topp Industries, Inc., "2017 Product Catalog", http://www.toppindustries.com/upload/documents/topp_2017_product_catalog_website_secure.pdf, Jan. 2017.

* cited by examiner

WASTEWATER SUMP ASSEMBLY

BACKGROUND

1. Technical Field

The present disclosure relates to a wastewater sump assembly for receiving and disposing of undesired fluid and, in some cases, solid waste.

2. Description of the Related Art

Buried sumps are utilized to collect and retain undesired liquid and, in some cases, solid waste. The unwanted material (generally referred to as "wastewater") is collected in the sump for later pumping to, e.g., an appropriate sewage treatment system such as a city sewer or septic tank. Such devices have particular applicability in instances where sewage cannot flow via gravity to a septic tank or a municipal sewage system. In these cases, the sewage must be pumped to such systems. For example, many residential homes have finished basements including bathrooms which are situated below grade. In such installations, bathroom waste can travel via a gravity flow to a buried sump having a submersible pump useful for periodically removing such waste as the sump reaches a predetermined level of collected wastewater.

Typically, the sump will include an inlet formed through a sidewall and receiving the wastewater to be removed. A submersible pump will be housed in the sump and include an actuator such as a float switch which switches on the submersible pump at a defined collection level. A pump outlet is typically positioned through the top of the sump and fluidly connected to the submersible pump such that the submersible pump discharges the sump contents through the outlet.

The sump is typically buried below the floor and can be cemented in place in the foundation of, for example, a residence. To provide access to the sump for servicing and/or replacement of the pump and/or pump switch, a lid is selectively securable to the top of the sump. Typical sump assemblies utilize a lid which has a circumferential extent that very closely approximates the circumferential extent of the vertical sump wall. In these installations, the sump wall terminates at the top of the sump and the detachable lid comprises the top surface of the enclosed sump chamber. The pump outlet is piped through the lid and therefore, lid removal necessitates moving the lid relative to the pump outlet which may require attachment and detachment of the pump outlet to the pump and/or resealing of the pump outlet relative to the lid. Further, such arrangements require very lengthy seals between the sump lid and the sump body, as the lid is sized to be generally coextensive with the upright wall defining the sump basin.

Alternative sump lids include split lid assemblies in which the typical, generally circular lid is split into two pieces. An example of such a lid can be found in U.S. Pat. No. 4,832,227. In a split lid configuration, sealing must be provided not only around the entire circumference of the two lid halves but also between the split in the two piece lid assembly. Therefore these assemblies require even longer runs of sealing between the sump lid and sump basin.

SUMMARY OF THE INVENTION

The present disclosure relates to a wastewater sump assembly for receiving and disposing of undesired fluid and, in some cases, solid waste. Exemplary embodiments of the present disclosure include a sump basin having a base, an upstanding wall and a top extending inwardly from the upstanding wall. The base, upstanding wall and top are formed of an integral, monolithic material so that no seams are presented between the base and the upstanding wall and no seams are presented between the upstanding wall and the top. Because the top of the sump basin is defined by a wall that is monolithically and integrally formed with the upstanding wall of the sump basin, a seal surrounding the perimeter of the sump basin is not required.

The top of the monolithic basin of the present disclosure includes a pump access aperture sized to allow passage of a submersible pump. A pump access cover is provided to completely cover and seal the pump access aperture. A number of fasteners are utilized to selectively secure the pump access cover to the basin, with the pump access cover hermetically sealed relative to the basin top. With the pump access cover secured in position, it is flush or recessed with the top of the sump defined by the integral, monolithic wall of the sump.

A submersible pump positioned within the sump includes a discharge outlet connected to vertical piping which may extend through the top of the sump. In an exemplary embodiment of the present disclosure, the discharge piping may be connected to an outlet pipe stub positioned through the top of the sump and terminating in a recessed area recessed from the uppermost portion of the sump. The recessed area may also include a vent pipe stub positioned through the top of the sump, but completely contained within the recessed area, so that an item positioned flush with the uppermost portion of the sump will not contact either the outlet pipe stub or the vent pipe stub. Providing outlet and vent pipe stubs which are positioned in a recessed area of the top of the sump facilitates easy connection to outlet and vent piping, while also allowing for the easy stacking of a plurality of sump assemblies one atop the other for storage prior to delivery to the job site.

A variety of switches can be utilized to actuate the submersible pump housed within the sump of the present disclosure. Embodiments of the present disclosure utilize a switch access cover which can be secured and hermetically sealed relative to the basin top. Like the discharge and vent pipe stubs, the switch access cover can be positioned in a recessed area, so that no part of the switch assembly extends above the uppermost portion of the sump top. Alternative switch assemblies useable with the present disclosure include float assemblies and a diaphragm switch assembly. Switch assemblies of the present disclosure include congruent switch access covers to allow for easy removal and replacement of a switch of a first type with a switch of the second type.

In embodiments of the present disclosure, the switch access cover covers and hermetically seals a switch access aperture sized to allow passage of a float switch. In alternative embodiments of the present disclosure, the switch access cover may include a cord access aperture through which at least one electric cord passes. The switch assembly of this form of the present disclosure may further include a cord seal including an electric cord aperture, the cord seal operable to sealingly engage the electric cord and the switch access cover to provide a fluid tight seal therebetween. The switch assembly of this form of the present disclosure may further include a U-shaped handle rotatably connected to the switch access cover. The U-shaped handle having a base and a pair of extensions extending from the base to form the "U-shape". One of the pair of extensions of the U-shaped handle has a first rotated position in which such extension engages the cord seal to retain the cord seal in sealing engagement with the switch access cover and the electric cord and a second rotated position in which it disengages the cord seal. In alternative forms of the present disclosure an E-shaped handle may be utilized in lieu of a U-shaped handle, with one of the three extensions from the base of the E acting as described above with respect to the U-shaped handle to selectively engage the cord seal to retain the cord seal in sealing engagement with the switch access cover and the electric cord.

Alternative embodiments of the present disclosure may utilize a diaphragm switch which is positioned outside of the sump. The diaphragm switch of this form of the present disclosure includes a diaphragm housing with a diaphragm positioned in the diaphragm housing and hermetically sealed relative to the housing so as to divide the housing into a sensing chamber and a switching chamber. The sensing chamber is hermetically sealed by the diaphragm from the switching chamber. The switching chamber is fluidly connected to ambient air, while the sensing chamber is fluidly connected with the interior of the sump basin by a riser. The riser is positioned such that an opening in the distal end of the riser is in fluid communication with a quantity of fluid contained in the sump. As the quantity of fluid in the sump rises, the diaphragm switch is actuated to close a switch and allow operation of the submersible pump to expel the contents of the sump until the pressure against the diaphragm is decreased to a set point, deactuating the diaphragm switch.

The disclosure, in one form thereof, provides a wastewater sump including a basin formed from a base, an upstanding wall extending upwardly from the base, and a top extending inwardly from the upstanding wall. In this form of the present disclosure, the base, upstanding wall and top may be formed of an integral, monolithic material, whereby no seams are presented between the base and the upstanding wall and no seams are presented between the upstanding wall and the top. The basin includes an inlet sized to allow ingress of a quantity of sump contents in the form of at least one of a liquid and a liquid/solid mixture and an outlet sized to allow egress of the sump contents. In forms of the present invention, the outlet may be formed through the top of the basin. The basin of the present disclosure is sized to receive a submersible pump useable to expel the contents of the basin.

In certain alternative forms of the present disclosure, the basin may have a capacity of at least 30 gallons. In alternative forms of the present disclosure, the upstanding wall of the basin defines an upstanding wall perimeter adjacent to the top, the top occupying at least 50% of an area defined by the upstanding wall perimeter adjacent to the top. In alternative forms of the present disclosure, the top may occupy 50% to 70% of an area defined by the upstanding wall perimeter adjacent to the top.

In alternative forms of the present disclosure, the inlet may be positioned through the upstanding wall. Further, the basin may include a vent aperture formed through the top of the basin.

In certain forms of the present disclosure, the wastewater sump upstanding wall defines an upstanding wall perimeter adjacent to the top, with the top including a recessed area so that the top extends from the upstanding wall perimeter transverse to the upstanding wall until reaching the recessed area, the top extending a recess distance toward the base at the recessed area and further extending toward the upstanding wall at the recess distance to form a recessed surface extending transverse to the upstanding wall. In this form of the present disclosure, the outlet and vent aperture may be formed in the recessed surface.

In alternative forms of the present disclosure, the wastewater sump may include a vent conduit extending through a vent aperture and a discharge conduit extending through a discharge outlet. In certain forms of the present invention, the vent conduit and the discharge conduit may extend externally of the basin from a surface recessed from the top such that the vent conduit and the discharge conduit present external connection piping that is recessed from the top of the basin.

In certain forms of the present disclosure, the wastewater sump may include a pump access cover, with the top of the basin having a pump access aperture sized to allow passage of the submersible pump, the pump access cover is sized to completely cover the pump access aperture. A pump access cover seal may be associated with the pump access cover to sealingly engage the pump access cover in the basin when the pump access cover is secured to the basin. A plurality of fasteners may be employed for selectively securing the pump access cover to the basin, the pump access cover defining the largest opening in the top of the basin. In alternative forms of the present disclosure, an outlet and vent aperture may be formed through the basin and will be discrete from the pump access opening. In certain forms of the present disclosure, the pump access aperture may define a circular aperture having a diameter of no more than 12 inches. In alternative forms of the present disclosure, the pump access aperture may have a diameter of about 10-16 inches.

In alternative forms of the present disclosure, the top of the basin may include a switch access aperture sized to allow passage of a float switch. In these forms of the present disclosure, a switch access cover sized and configured to selectively completely cover the switch access aperture is provided, with a switch access cover seal associated with the switch access cover to selectively sealingly engage the switch access cover and the basin when the switch access cover is secured to the basin. A plurality of fasteners may be employed to selectively secure the switch access cover to the basin. The switch access aperture may, in certain embodiments, be formed in a recess surface in the top of the basin such that the switch access cover is securable to the recessed surface but does not protrude beyond the top of the basin.

Certain embodiments of the switch access covers of the present disclosure may include U or E-shaped handles rotatably connected to the switch to provide a gripping surface for removal of the switch access cover and to selectively secure a cord seal in place relative to the switch access cover.

Switches such as float switches and diaphragm switches may be employed to actuate the submersible pump utilized with the present disclosure. In certain embodiments of the present disclosure, a diaphragm switch may include a housing secured to a switch access cover, so that with the switch access cover secured to the basin, the diaphragm housing is positioned external of the basin. In these forms of the present disclosure, a diaphragm is positioned in the diaphragm housing and hermetically sealed relative to the diaphragm housing so as to divide the housing into a sensing chamber and a switching chamber. The sensing chamber is hermetically sealed by the diaphragm from the switching chamber and the switching chamber is fluidly connected to ambient pressure. A switch is housed in the switching chamber and a riser pipe is placed in fluid communication with the sensing chamber and the diaphragm. The riser pump extends into the sump and includes an open distal end spaced from the diaphragm housing. The contents of the sump basin can flow into the riser pipe such that they will cause an increased pressure on the diaphragm to selectively actuate the switch contained in the switching chamber. In alternative forms of the present disclosure, two different switch types are secured to congruent switch access covers and are selectively securable to the sump so that alternative switch subassemblies may be utilized to selectively actuate a submersible pump placed in the sump basin.

In alternative forms of the present disclosure, a wastewater sump may include a basin formed from a base, an upstanding wall extending upwardly from the base and a top extending inwardly from the base, the base, the upstanding wall and the top formed of an integral, monolithic material, so that no seams are presented between the base and the upstanding wall and no seams are presented between the upstanding wall and the top. The basin may include an inlet sized to allow ingress of a quantity of sump contents in the form of at least one of a liquid and a liquid/solid mixture and an outlet to allow egress of the sump contents, with the basin sized to receive a submersible pump to effect removal of the sump contents. The top of the basin of this form of the present disclosure includes a pump access aperture sized to allow passage of the submersible pump and a pump access cover sized to completely cover the pump access aperture. The pump access cover seal may be associated with the pump access cover to sealingly engage the pump access cover and the basin when the pump access cover is secured to the basin. A plurality of fasteners may be utilized to selectively secure the pump access cover to the basin. The pump access cover of this form of the present disclosure defines the largest opening in the top of the basin. The top of the basin defines a sump perimeter adjacent to a transition from the upstanding wall to the top. The pump access cover defines a pump access cover perimeter such that the pump access cover perimeter has a length of no more than about 60% of the length of the sump perimeter. A number of fasteners may be positioned adjacent to the pump access cover perimeter to hermetically seal the pump access cover to the basin.

The present disclosure describes and illustrates a number of different features associated with a sump basin. Features described and illustrated with reference to any single embodiment of the present disclosure may be incorporated into all other embodiments of the present disclosure. Stated another way, any of the various features described in this document may be interchangeably used with any combination of the remaining features.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
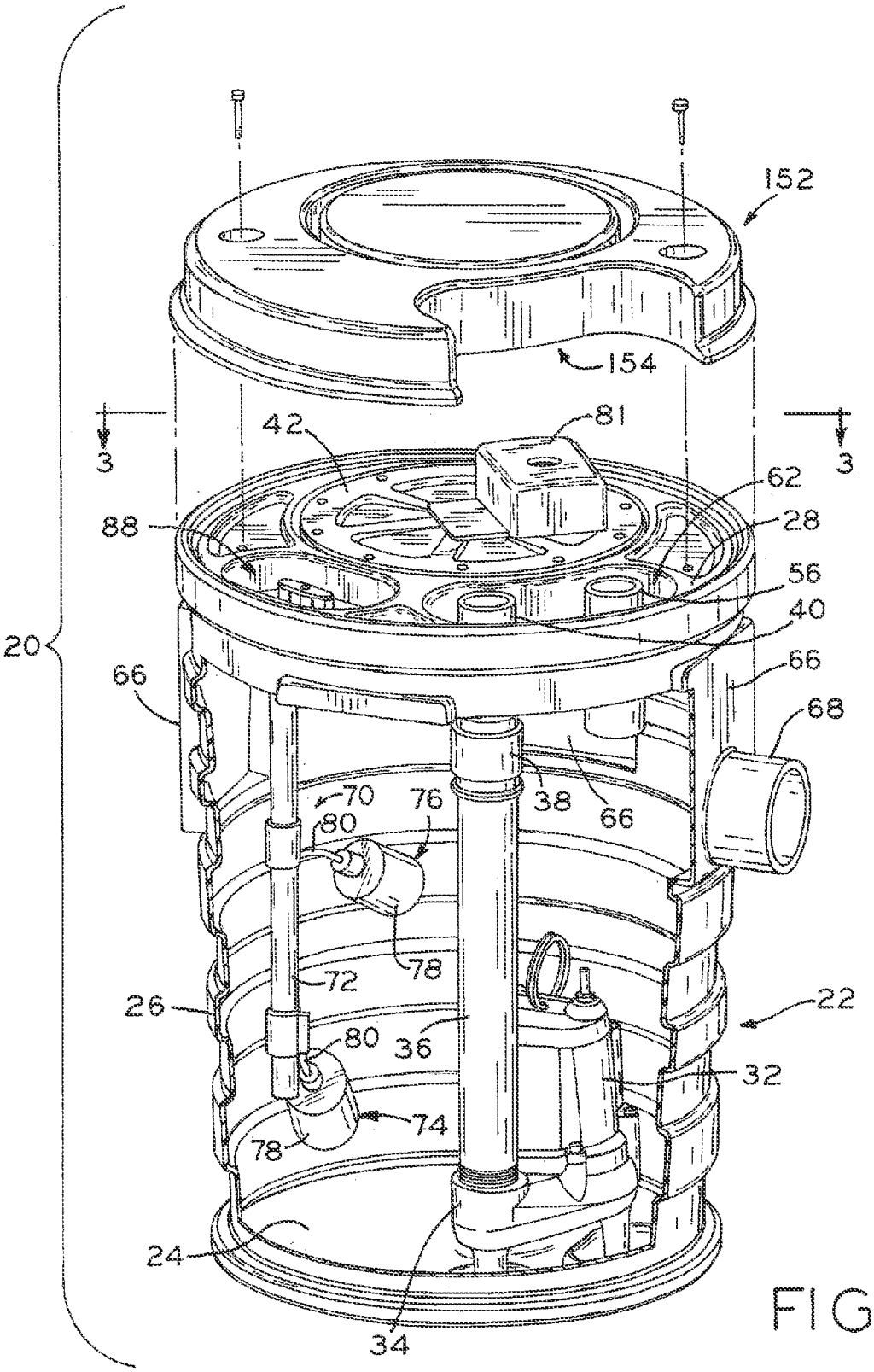
FIG. 1 is a perspective, partial sectional view of a sump assembly in accordance with the present disclosure.

Corresponding reference characters indicate corresponding parts throughout the several views. Although the exemplifications set out herein illustrate embodiments of the invention, in several forms, the embodiments disclosed below are not intended to be exhaustive or to be construed as limiting the scope of the invention to the precise forms disclosed.

DETAILED DESCRIPTION OF THE EXEMPLARY EMBODIMENTS OF THE PRESENT INVENTION

Referring to FIG. 1, sump assembly 20 includes basin 22 formed from base 24, upstanding wall 26 and top 28. As illustrated, upstanding wall 26 extends axially upwardly from base 24 and top 28 extends radially inwardly from upstanding wall 26. Basin 22 is a rotational molded (sometimes referred to as "roto molded") polyethylene basin, with an integral, monolithic material forming base 24, upstanding wall 26 and top 28. Basin 22 may have a capacity of about 30, 40, 50 or 60 gallons. In an alternative embodiment, basin 22 may have a capacity anywhere in the range of about 30-60 gallons. With base 24, upstanding wall 26 and top 28 roto molded to be formed from an integral, monolithic material, no seams are presented between base 24 and upstanding wall 26. Similarly, no seams are presented between upstanding wall 26 and top 28. Because top 28 of basin 22 is defined by a wall that is monolithically and integrally formed with upstanding wall 26 of basin 22, a seal surrounding the perimeter of basin 22 is not required to fluidly isolate the interior cavity of sump assembly from the ambient environment, as further described below.

Figure 2:
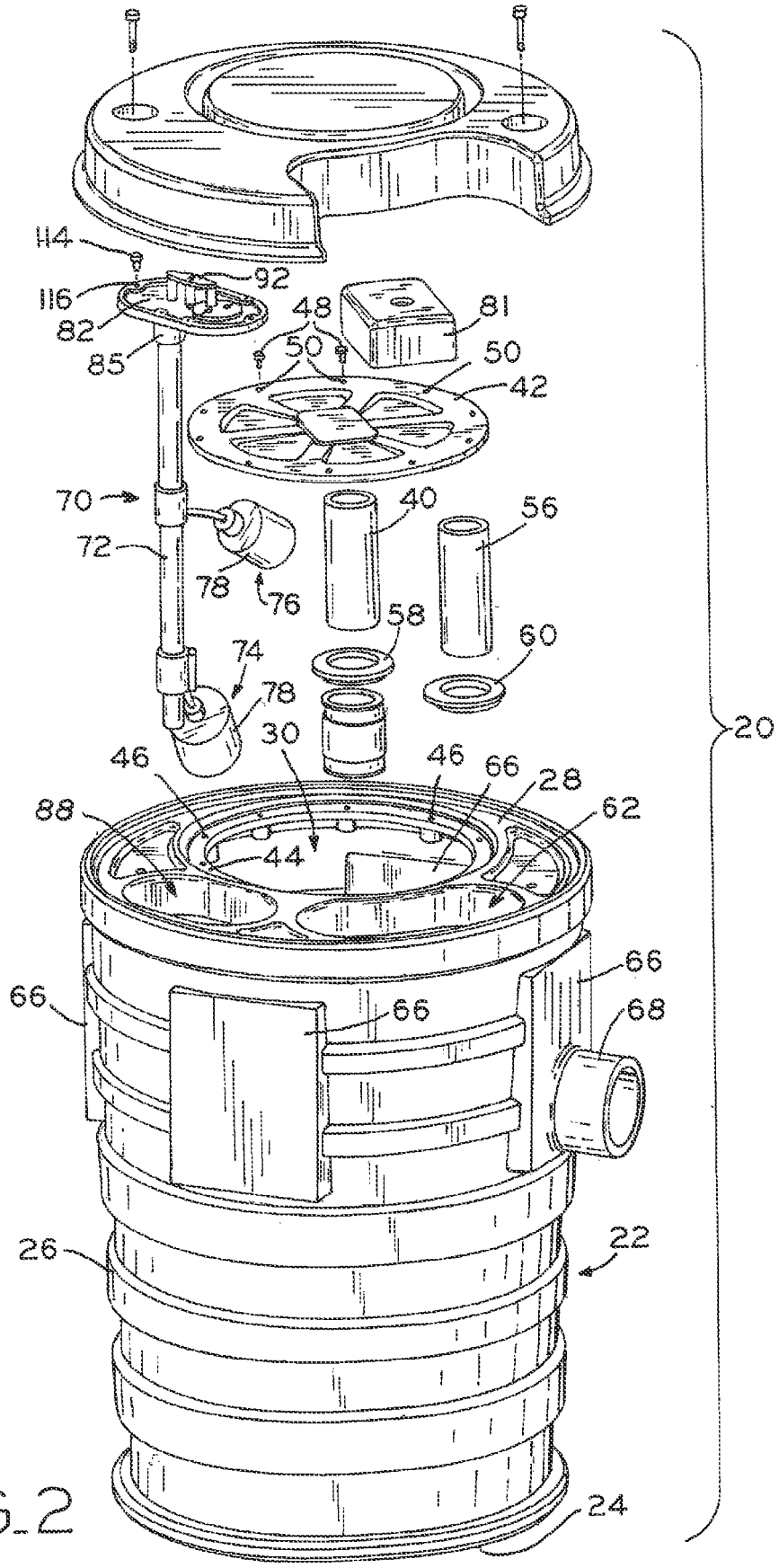
FIG. 2 is an exploded view illustrating a sump assembly in accordance with the present disclosure.

Upstanding wall 26 of basin 22 includes four inlet pads 66 evenly circumferentially spaced about the outer surface of wall 26, as illustrated in FIGS. 1 and 2. A first inlet pad 66 includes inlet 68 comprising an open ended channel formed therethrough. Inlet 68 may be integrally roto molded with the remainder of basin 22. The remaining three inlet pads 66 can be drilled to provide additional inlets should basin 22 be connected to multiple sources of wastewater.

Figure 4:
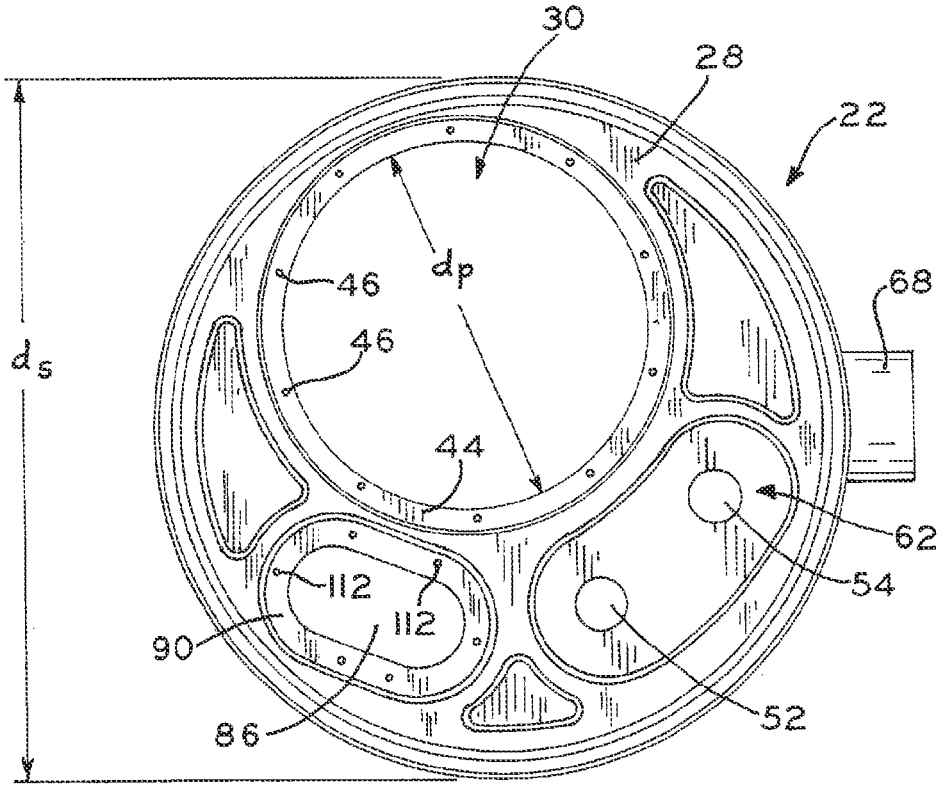
FIG. 4 is a plan view illustrating the sump basin of the present disclosure with the pump access cover and switch access cover removed.

Referring to FIGS. 2 and 4, basin 22 includes pump access aperture 30 formed through top 28. Pump access aperture 30 is sized to allow passage of submersible pump 32 (FIG. 1). Submersible pump 32 may be a Franklin Electric model 9SN-CIM submersible pump, available from Franklin Electric, Co. of Fort Wayne, Ind. Referring to FIG. 4, exemplary basin 22 includes an outermost extent defining diameter $d_S$ of about 24 inches. Upstanding wall 26 generally diverges (e.g., in a frusto-conical fashion) from base 24 to top 28 such that the radial outermost extent of basin 22 is defined adjacent to top 28. In an embodiment in which $d_S$ is about 24 inches, the diameter of pump access aperture 30, $d_P$ is about 12 inches.

Pump access aperture 30 defines the largest opening in the top of basin 22. Because diameter $d_P$ defines a perimeter that is substantially less than the perimeter defined by diameter $d_S$, significantly less lineal sealing distance is required to seal the top of basin 22 relative to prior art embodiments in which the sump top was formed as a discrete separate part which was sealed relative to the upstanding wall of the predicate sump basins. As depicted in the attached drawings, pump access aperture 30 defines a circular aperture through top 28 of basin 22. In alternative embodiments, pump access aperture 30 may be generally (that is, approximately) circular, e.g., it may be defined by a polygon of at least 5 sides. In the event that pump access aperture 30 is polygonal in form, its size would be defined by the radius or diameter of the largest circle circumscribed by such polygon.

Submersible pump 32 (FIG. 1) is an impeller pump having an inlet through which submersible pump 32 draws fluid and solids contained in basin 22 to be expelled by the impeller through pump outlet 34. After submersible pump 32 is received into basin 22 through pump access aperture 30, outlet pipe 36 is secured to pump outlet 34, e.g., by threading. Outlet pipe 36 terminates short of the underside of top 28 of basin 22. Elastomeric pipe sleeve 38 is positioned about outlet pipe 36 and outlet pipe stub 40 (FIG. 2), which will be described in more detail below. Hose clamps may be utilized to secure elastomeric pipe sleeve 38 to outlet pipe 36 and outlet pipe stub 40. Outlet pipe stub 40 can then be connected to further outlet piping connected to, e.g., a city sewer or septic tank.

FIGS. 2 and 4 illustrate pump access cover 42 removed from basin 22 to allow insertion or removal of submersible pump 32. Basin 22 includes flange 44 defined around pump access aperture 30. A plurality of fastener receptacles 46 are positioned about flange 44. Fastener receptacles 46 may take the form of, e.g., aluminum inserts positioned through flange 44 and adapted to receive a plurality of fasteners 48. Fasteners 48 may be externally threaded bolts sized to cooperate with internal threaded apertures formed in fastener receptacles 46. In use, fasteners 48 are positioned through fastener apertures 50 in pump access cover 42 to hermetically seal pump access cover 42 to top 28 of basin 22. Prior to securement of fasteners 48, a seal is interposed between pump access cover 42 and flange 44. Such a seal may be an annular, elastically deformable gasket incorporated into the under surface of pump access cover 42, or positioned atop flange 44. With pump access cover 42 secured in position, as illustrated in FIG. 1, it is flush with top 28 of basin 22, owing to the fact that flange 44 is recessed from the uppermost surface of top 28.

Figure 3:
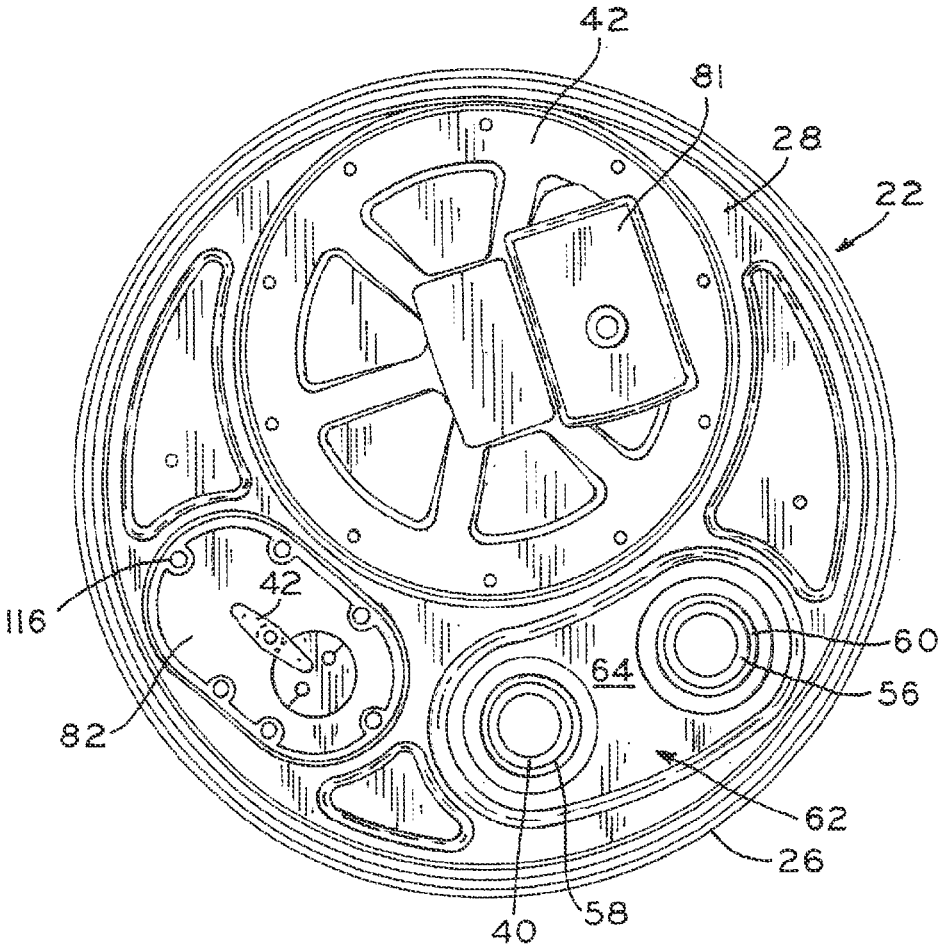
FIG. 3 is a plan view of a sump assembly of the present disclosure showing the pump access cover and the switch access cover engaged with the top of the sump and further illustrating an alarm positioned atop the sump access cover for packaging.

Referring to FIG. 4, top 28 includes discharge aperture 52 and vent aperture 54 formed therethrough. Referring to FIG. 2, outlet pipe stub 40 and vent pipe stub 56 are sized to be positioned through discharge aperture 52 and vent aperture 54 (FIG. 4), respectively. Seal 58 is interposed between outlet pipe stub 40 and discharge aperture 52 to effect sealing therebetween. Similarly, seal 60 is interposed between vent pipe stub 56 and vent aperture 54 to effect sealing therebetween. Referring to FIGS. 1-4, outlet pipe stub 40 and vent pipe stub 56 both extend through top 28 and into recessed area 62 formed in top 28. Recessed area 62 is formed by top 28 having an extension extending axially downwardly a recess distance toward base 24 and thereafter extending in a transverse direction (e.g., radially outwardly and/or inwardly) toward upstanding wall 26 to form recess surface 64 (FIG. 3). With outlet pipe stub 40 and vent pipe stub 56 positioned in recessed area 62, outlet pipe stub 40 and vent pipe stub 56 are both positioned external to basin 22 and available for securement to further piping to define the outlet and vent extending from basin 22, without extending past the uppermost extent (i.e., the axial terminal end) of basin 22. As described above, the outlet may be fluidly connected with a city sewer or septic tank. The vent may be fluidly connected to a pipe extending through the roof of the residence in which basin 22 is installed to allow for venting of the interior of basin 22 to ensure that a pressure buildup therein does not occur.

A variety of switches can be utilized to actuate submersible pump 32 to remove wastewater previously received through inlet 68 into basin 22. Any of the many, well known float switches may be utilized in accordance with the present invention. In the embodiment illustrated in FIG. 1, float switch 74 is operable to actuate submersible pump 32. Float switch 74 includes electric cord 80 extending therefrom. Electric cord 80 is tethered to riser 72 such that the buoyancy of float 78 on fluid in basin 22 will cause a change in the attitude of float 78 to open or close the electric circuit depending on whether the fluid in basin 22 is rising or lowering.

Float switches 74, 76 may be Franklin Electric Model RFSN series float switches available from Franklin Electric Co., Inc of Fort Wayne, Ind. Each of float switches 74, 76 includes a float 78 including a sphere positioned within a raceway and operable to open and close an electrical circuit in response to a change in attitude of the float, which causes a repositioning of the sphere. Electric cords 80 extending from and electrically connected to floats 78 may terminate in a piggyback plug having a male electrical connector for connection to a standard wall outlet and a female electrical connector for further connection to a subsequent male connector. With the piggyback plug connected to a wall outlet, floats 78 are operable to selectively close an electric circuit through the piggyback plug to allow the passage of current therethrough.

Specifically, electric cord 80 is connected at its distal end (not shown) to a piggyback connector configured to be engaged with a standard wall socket. Similarly, an electric cord is connected to submersible pump 32 and is operable to provide power to submersible pump 32 to actuate submersible pump 32. Submersible pump 32 does not include an integral switch and therefore operates when it receives electrical current. Because it is connected to a wall outlet through the piggyback switch of float switch 74, closing of the circuit caused by raising the float 78 associated with float switch 74 completes the circuit from the electrical cord associated with submersible pump 32 to the wall outlet to actuate submersible pump 32. Float switch 76 operates in a similar fashion and may be connected to an alarm which indicates that submersible pump 32 is not functioning properly and therefore the liquid level in basin 22 is rising higher than that which would be allowed by float switch 74. Such an alarm is schematically illustrated as alarm 81 in FIGS. 1-3 of the present application. In the event that float switches 74 and 76 are both utilized with a submersible pump 32, three electric cords will extend from the interior of basin 22 to an exterior thereof.

Floats 78 may be made in accordance with the disclosure of U.S. Pat. Nos. 5,087,801 and 5,142,108, the entire disclosures of which are both explicitly incorporated by reference herein. For example, each float 78 of float switches 74, 76 may include an internal ball which, with floats 78 positioned as illustrated in FIG. 1, with a distal end thereof pointed downwardly toward base 24 of basin 22, is incapable of closing the electric circuit to allow current to flow from the wall socket through a piggyback plug connected to the float switch and thereafter to the power cord of submersible pump 32. If the attitude of a respective float switch 74 or 76 is changed such that the distal end thereof points upwardly toward top 28 of basin 22, then the internal ball will actuate a contact to electrically close the electrical circuit and allow current from the wall outlet to pass through the piggyback switch into the plug of the power cord of submersible pump 32 to energize submersible pump 32.

Figure 5:
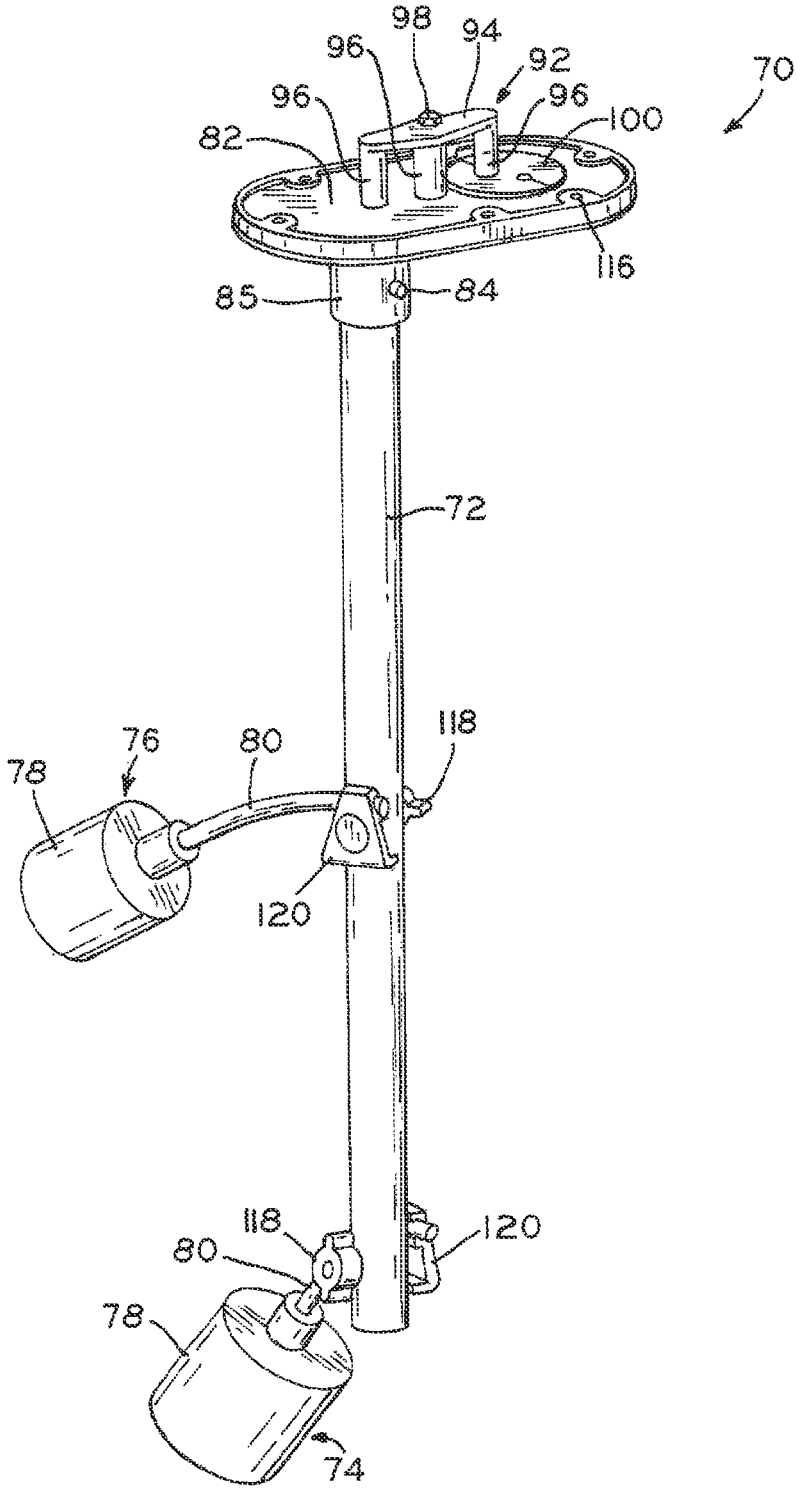
FIG. 5 is a perspective view of a float assembly in accordance with the present disclosure.

Referring still to FIGS. 1, 2 and 5, riser 72 of float switch subassembly 70 is secured to switch access cover 82. Specifically, clevis pin 84 (FIG. 5) is positioned through a transverse aperture in both riser 72 and boss 85, which extends downwardly from switch access cover 82 and into which riser 72 is positioned. Referring to FIG. 4, switch access aperture 86 is sized to allow passage of float switches 74, 76 so that, with float switches 74, 76 secured to riser 72, riser 72 and switches 74, 76 may all be inserted from an exterior of basin 22 through switch access aperture 86 to position float switches 74, 76 within basin 22. Switch access cover 82 is sized to completely cover switch access aperture 86 and be positioned within recessed area 88 as illustrated, e.g., in FIG. 1. Recessed area 88 is formed by top 28 having an extension extending axially downwardly by a recess distance toward base 24 and thereafter extending in a transverse direction (e.g., radially outwardly and/or inwardly) toward upstanding wall 26 to form recessed surface 90 (FIG. 4). A plurality of fastener receptacles 112 (FIG. 4) are positioned about recessed surface 90. Fastener receptacles 112 may take the form of, e.g., aluminum inserts positioned through recessed surface 90 and adapted to receive a plurality of fasteners 114 (FIG. 2). Prior to securement of fasteners 114, a seal is interposed between switch access cover 82 and recessed surface 90. Such a seal may be an annular, elastically deformable gasket incorporated into the undersurface of switch access cover 82, or positioned atop recessed surface 90. With switch access cover 82 secured in position, as illustrated in FIG. 1, the entire float switch subassembly 70 is recessed from the upper most surface of top 28.

Figure 6:
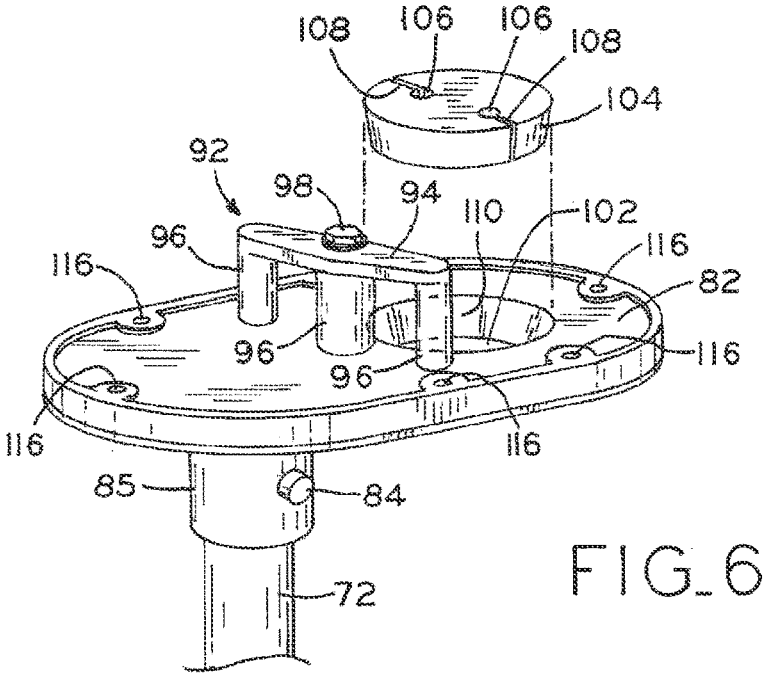
FIG. 6 is a partial perspective view of the float assembly of FIG. 7, illustrating the E-shaped handle articulated to a position allowing for removal of the cord seal.
Figure 7:
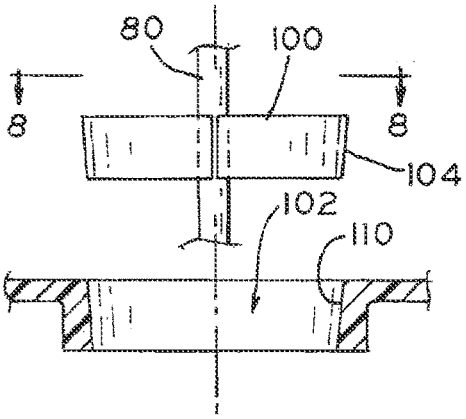
FIG. 7 is an exploded elevation view illustrating the cord seal of FIG. 6 positioned about an electric cord prior to engagement with the switch access cover illustrated in FIG. 6.
Figure 9:
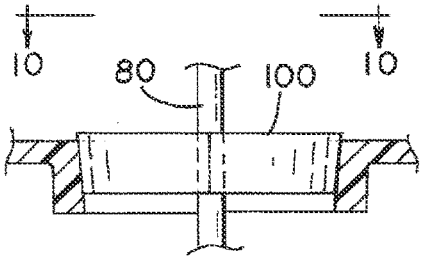
FIG. 9 is an elevation, partial sectional view illustrating the electric cord seal engaged with the switch plate to seal an electric cord relative to the switch plate.
Figure 8:
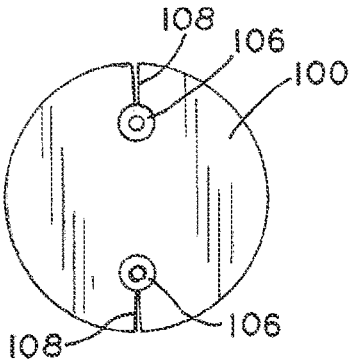
FIG. 8 is a plan view of the cord seal illustrated in FIG. 7.

Referring to FIG. 6, switch access cover 82 includes cord access aperture 102 through which electric cords 80 of float switches 74, 76 and the power cord to submersible pump 32 can be positioned. Referring to FIGS. 6-10, cord seal 100 comprises a grommet having a compressible, tapered wall 104, cord apertures 106 and radial slits 108. In one exemplary embodiment, cord seal 100 is made in accordance with U.S. Pat. No. 6,348,657, the entire disclosure of which is hereby explicitly incorporated by reference herein. In the embodiment illustrated, cord seal 100 includes two cord apertures 106. In this embodiment, the electrical cord from submersible pump 32 and an electrical cord from one float switch 74 may pass through cord seal 100. In alternative embodiments, utilizing alarm float switch 76, cord seal 100 will include three cord apertures 106 and associated radial slits 108. Each cord aperture 106 includes a radial slit 108 extending radially outwardly therefrom and intersecting tapered wall 104. Radial slits 108 may be utilized to allow electric cord 80 to pass from tapered wall 104 to cord apertures 106. With one or more electric cords 80 traversing cord apertures 106, cord seal 100 can be positioned within cord access aperture 102.

Figure 10:
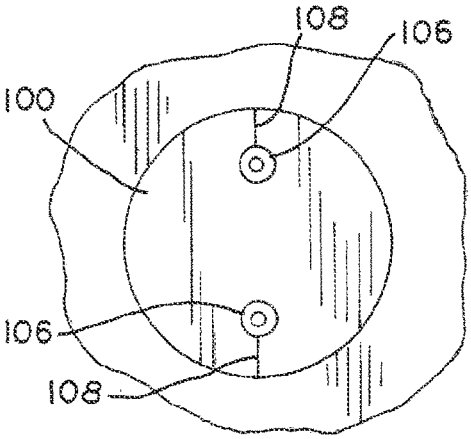
FIG. 10 is a partial plan view of the assembly illustrated in FIG. 9.

In one exemplary embodiment, cord access aperture 102 is formed from tapered wall 110. Tapered wall 110 includes a taper angle similar to tapered wall 104 of cord seal 100. With electric cord(s) positioned through cord apertures 106, cord seal 100 may be pressed into cord access aperture 102 such that tapered wall 110 cooperates with tapered wall 104 of cord seal 100 to compress cord seal 100 and sealingly engage the opposing walls forming radial slits 108, as illustrated in FIG. 10. In the configuration illustrated in FIG. 10 (and with electric cords 80 occupying cord apertures 106), cord seal 100 cooperates with switch access cover 82 to seal electrical cords 80 passing through cord access aperture 102 relative to switch access cover 82.

Referring to FIGS. 5-10, float switch subassembly 70 includes E-shaped handle 92 selectively pivotally secured to switch access cover 82. E-shaped handle 92 includes base 94 with extensions 96 extending therefrom to create an "E" shape. Intermediate extension 96 is cannulated such that pivot bolt 98 extends therethrough. Pivot bolt 98 may be secured to switch access cover 82 by threaded engagement into a blind bore formed in switch access cover 82. Pivot bolt 98 may be loosened such that E-shaped handle 92 is pivotable about pivot bolt 98 such that E-shaped handle 92 may be rotated to the position illustrated in FIG. 6 in which no extensions 96 of E-shaped handle 92 engage cord seal 100. E-shaped handle 92 may also be rotated from the position illustrated in FIG. 6 to the position illustrated in FIG. 5 in which one of extensions 96 engages cord seal 100 to hold cord seal 100 firmly in place relative to switch access cover 82. In this position, pivot bolt 98 can be tightened such that E-shaped handle 92 is no longer pivotable relative to switch access cover 82 and the extension 96 firmly abuts cord seal 100. With extension 96 engaging cord seal 100, cord seal 100 cannot be disengaged from the frictionally engaged position illustrated in FIG. 9.

While handle 92 is described as having an "E" shape, taking ½ of base 94 and two adjacent extensions 96, it can also be said that handle 92 is "U" shaped. In this regard, it is noted that only two extensions 96 are necessary to achieve the functionality described above. Therefore, a U-shaped handle 92 defined by two neighboring extensions 96 is also contemplated within the present disclosure.

Switch access cover 82 has a generally symmetrical outer perimeter; however, fastener apertures 116 through which fasteners 114 are positioned (FIG. 2) to secure switch access cover 82 to basin 22 are asymmetrically arranged as illustrated, e.g., in FIG. 3. Asymmetric arrangement of fastener apertures 116 ensures that switch access cover 82 is repeatably securable in one orientation only relative to basin 22. Similarly, riser 72 may be keyed to boss 85 such that riser 72 is insertable in boss 85 only in a single predetermined orientation. Referring to FIG. 5, thumbscrews 118 and clamps 120 may be utilized to secure electric cords 80 to riser 72. Specifically, a lag bolt may be positioned through each clamp 120 and threadably engaged by thumbscrew 118, which takes the form of a threaded fastener such as a wingnut. Similarly, clamps 120 may be over molded about the head of a lag bolt, with the threaded end of the lag bolt extending therefrom. Riser 72 includes transverse apertures through which the bolts extending from clamps 120 can extend. As illustrated in FIG. 5, these transverse apertures are not aligned (i.e., the longitudinal axes of the apertures are not parallel), so that floats 78 will extend at different rotated positions with respect to riser 72. Keying of switch access cover 82 to sump basin 22, riser 72 to switch access cover 82 (via boss 85), and floats 78 relative to riser 72 ensures that floats 78 will be installed at a position of maximum open area in the interior of basin 22 and be free from obstruction from any adjacent structures. The thumbscrew/clamp combinations for tethering float switches 74, 76 to riser 72 further allow for quick and easy removal and replacement of the respective float switches.

Figure 11:
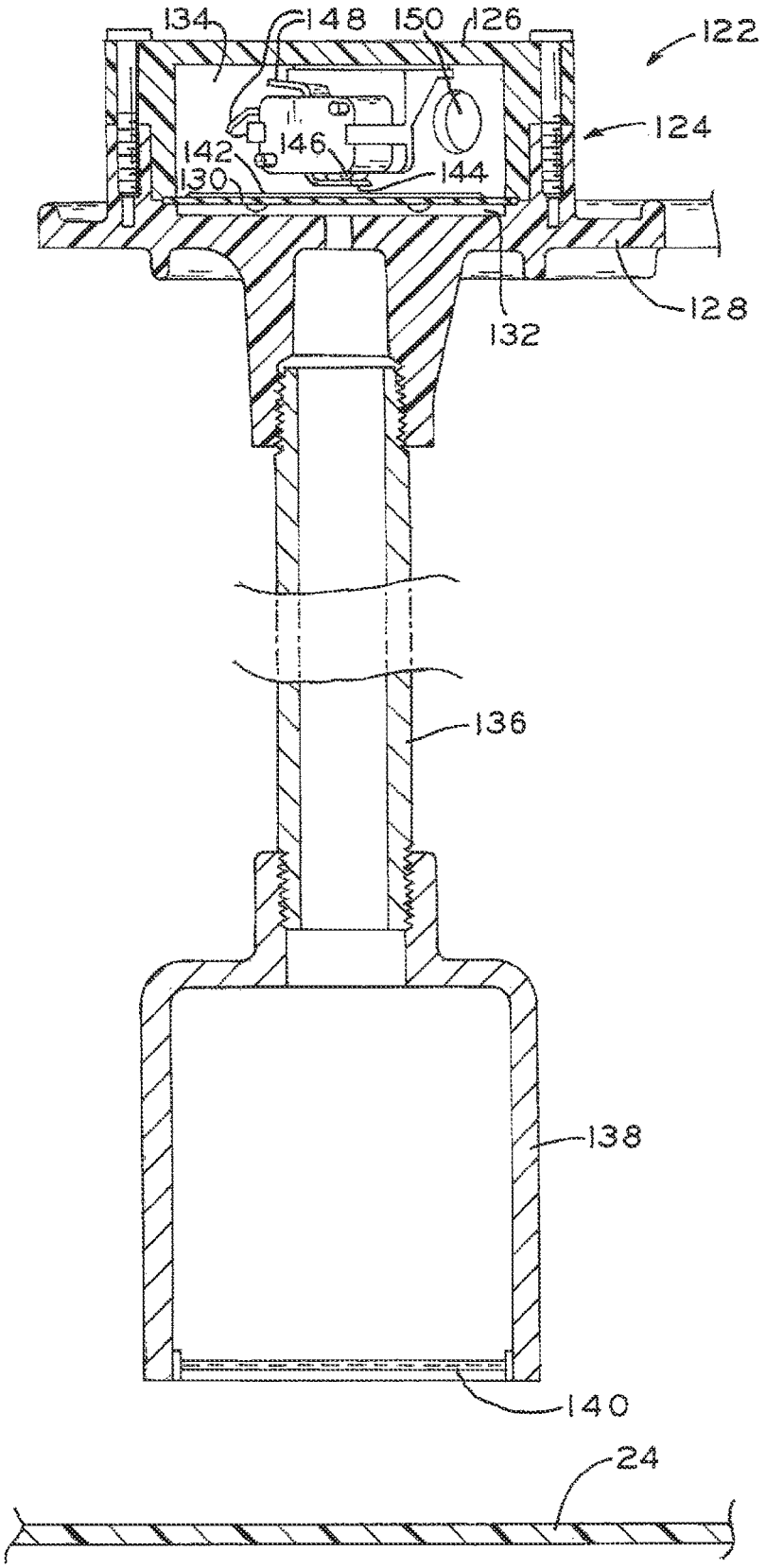
FIG. 11 is a sectional view of a diaphragm switch in accordance with the present disclosure.

FIG. 11 illustrates diaphragm switch subassembly 122. Diaphragm switch subassembly 122 may be utilized in place of float switch subassembly 70. Diaphragm switch subassembly 122 includes diaphragm housing 124 formed of upper diaphragm housing 126 secured to a lower diaphragm housing in the form of switch access cover 128. As illustrated in FIG. 11, lag bolts may be utilized to secure upper diaphragm housing 126 to switch access cover 128. Diaphragm 130 is positioned in diaphragm housing 124 and is hermetically sealed thereto. For example, diaphragm 130 may be trapped between upper diaphragm housing 126 and switch access cover 128. Diaphragm 130 is formed of an elastomeric material and separates diaphragm housing 124 into sensing chamber 132 and switching chamber 134. Sensing chamber 132 is fluidly connected with riser pipe 136 and end bell 138. In the sectional view illustrated, end bell 138 is shown positioned proximate to but spaced from base 24 of basin 22.

Screen 140 is positioned within an open end of end bell 138. With riser pipe 136 and end bell 138 positioned relative to base 24 of basin 22 as illustrated in FIG. 11, the contents of basin 22 in the form of liquid and/or liquid and solid waste can flow into riser pipe 136. Screen 140 has a pore size sufficient to filter large solids from entering end bell 138. With end bell 138 extending into the contents of basin 22 such that fluid in basin 22 covers the opening(s) in end bell 138, the fluid in basin 22 will cooperate with diaphragm 130 to hermetically seal the interior of end bell 138, riser pipe 136 and sensing chamber 132. As the fluid level in basin 22 rises, the air contained in end bell 138, riser pipe 136 and sensing chamber 132 will be forced upward against diaphragm 130. Switching chamber 134 is fluidly connected to ambient pressure by aperture 150. Therefore, as the level of fluid in basin 22 rises and the pressure in end bell 138, riser pipe 136 and sensing chamber 132 increases, a pressure differential forms that urges diaphragm 130 to expand and move upwardly. Owing to the elastomeric nature of diaphragm 130, it will, under the influence of such increased pressure, move upwardly into switching chamber 134. As illustrated in FIG. 11, diaphragm 130 includes metal plate 142 secured thereto. As the level of the contents in basin 22 rises and diaphragm 130 moves upwardly, metal plate 142 engages hinged arm 144 and presses hinged arm 144 toward the top of diaphragm housing 122 to actuate switch 146. Switch 146 is configured to close an electrical circuit between contacts 148 upon actuation of switch 146 by diaphragm 130, metal plate 142 and hinged arm 144. Contacts 148 may be electrically connected to a piggyback plug as described above with respect to float switch assembly 70.

In alternative forms of diaphragm switch subassembly 122, the distal end of riser pipe 136, i.e., end bell 138, may be in fluid communication with the contents of basin 22 not only through an open distal end of end bell 138, but also through transverse apertures in the wall defining end bell 138. Further, transverse apertures through the wall defining end bell 138 may be utilized in lieu of an open distal end of end bell 138. In such configurations, the distal end of end bell 138 may be positioned directly atop base 24 of basin 22, with the transverse apertures defining the "open distal end". If apertures through the wall defining end bell 138 are utilized to provide fluid communication between riser pipe 136 and the interior of basin 22, such apertures may be overlaid with a screen in similar fashion to the open distal end of end bell 138 illustrated in FIG. 11 to thereby prevent large particles from entering end bell 138. Further, the spacing of the distal end of end bell 138 relative to base 24 may be such as to preclude entry of large particles into end bell 138.

Switch access cover 128 includes a periphery identical to the periphery of switch access cover 82 of float switch subassembly 70, including an identical pattern of fastener apertures 116. Further, switch access cover 128 can be sealingly engaged with top 28 of basin 22 in the same manner described above with respect to switch access cover 82. Switch access cover 82 and switch access cover 128 are interchangeably securable to top 28 of basin 22. While not illustrated in FIG. 11, switch access cover 128 will include a cord access aperture similar to cord access aperture 102 (FIG. 6) of float switch subassembly 70. Because diaphragm housing 124 is positioned atop switch access cover 128 such that, with switch access cover 128 secured in position relative to basin 22, diaphragm housing 124 is positioned exterior of basin 22, an electrical cord connected to contacts 148 does not have to pass through top 28 of basin 22. Therefore, a cord seal associated with the cord access aperture through switch access cover 128 will not need to accommodate the electric cord from the switch assembly. Therefore, a cord seal having a single cord aperture and associated radial slit may be utilized to allow passage of the electrical cord from submersible pump 32. In the event that a secondary alarm float is tethered to riser pipe 136, the electrical cord associated therewith will pass through the cord access aperture and cord seal utilized with diaphragm switch subassembly 122. In such an embodiment, the cord seal will include two cord apertures and associated radial slits to allow passage of both the electrical cord associated with submersible pump 32 and the electrical cord associated with the alarm float switch.

As described above, top 28 is part of an integral, monolithic wall forming basin 22. In the exemplary embodiment illustrated, top 28 includes only four openings therethrough. Referring to FIG. 4, these four openings are: pump access aperture 30, switch access aperture 86, discharge aperture 52 and vent aperture 54. As described above, pump access aperture 30 is the largest aperture formed through top 28. In an exemplary embodiment, pump access aperture 30 accounts for removal of approximately 25% of the top area defined by the perimeter of upstanding wall 26 adjacent to top 28. Switch access aperture 86 together with discharge aperture 52 and vent aperture 54 may account for the loss of another 5% of such area such that top 28 presents a barrier to entry and exit through the perimeter of upstanding wall 26 adjacent to top 28 of at least 70% of such area. In alternative embodiments, top 28 presents a barrier to entry and exit through the perimeter of upstanding wall 26 adjacent to top 28 of at least anywhere in the range of 50-70% of such area. In embodiments, top 28 occupies 50% of the top area defined by the perimeter of upstanding wall 26 adjacent to top 28.

Referring to FIG. 1, shipping cover 152 may be secured to top 28 of basin 22, with alarm 81 positioned therebeneath for shipping. In use, Alarm 81 will be, e.g., wall mounted. Alarm 81 may include an audible and/or visible alarm signal which is triggered by actuation of an alarm switch such as float switch 76 described above.

As illustrated in FIG. 1, shipping cover 152 includes cutout 154 sized to accommodate passage of vent and discharge piping connected to vent pipe stub 56 and outlet pipe stub 40, respectively. Therefore, after installation of basin 22, shipping cover 152 may be re-secured to top 28 of basin 22 to provide for an aesthetically pleasing appearance while preventing debris from contacting the majority of top 28 of basin 22. Prior to shipping, shipping cover 152 may be affixed to top 28 of basin 22 such that cutout 154 is not aligned with discharge pipe stub 40 and vent pipe stub 56, so that shipping cover 152 prevents liquid from thereby entering basin 22. This can be particularly useful if basin 22 is stored outside prior to delivery to a customer.

While this invention has been described as having an exemplary design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A wastewater sump, comprising:

a basin formed from:

a base;

an upstanding wall extending upwardly from said base; and a top extending inwardly from said upstanding wall, said base, said upstanding wall and said top formed of an integral, monolithic material, whereby no seams are presented between said base and said upstanding wall and no seams are presented between said upstanding wall and said top, said basin having an inlet sized to allow ingress of a quantity of sump contents in the form of at least one of a liquid and a liquid/solid mixture, and an outlet sized to allow egress of said quantity of sump contents, said outlet formed through said top, said basin sized to receive a submersible pump, wherein said upstanding wall defines an upstanding wall perimeter adjacent to said top, said top including a recessed area, whereby said top extends from said upstanding wall perimeter transverse to said upstanding wall until reaching said recessed area, said top extending a recess distance toward said base at said recessed area to define a recess wall and further extending from the recess wall at said recess distance to form a recessed surface extending transverse to said upstanding wall, said outlet and a vent aperture formed in said recessed surface;

a vent conduit extending through said vent aperture, said vent conduit having a vent conduit external end extending externally of said basin, said vent conduit external end terminating at a distance from said recessed surface that is less than said recess distance, but more than zero whereby said vent conduit external end is in said recessed area, recessed from said top of said basin and surrounded by the recess wall;

a discharge conduit extending through said outlet, said discharge conduit having a discharge conduit external end extending externally of said basin, said discharge conduit external end terminating at a distance from said recessed surface that is less than said recess distance, but more than zero whereby said discharge conduit external end is in said recessed area, recessed from said top of said basin and surrounded by the recess wall; and a shipping cover securable to the top of the basin, the shipping cover including a cutout sized to accommodate passage of the vent conduit and the discharge conduit through the cutout.

2. The wastewater sump of claim 1, wherein said upstanding wall defines an upstanding wall perimeter adjacent to said top, said top occupying 50% to 70% of an area defined by said upstanding wall perimeter adjacent to said top.

3. The wastewater sump of claim 1, wherein said inlet is positioned through said upstanding wall.

4. The wastewater sump of claim 1, further comprising:

a pump access cover, said top of said basin having a pump access aperture sized to allow passage of the submersible pump, said pump access cover sized to completely cover said pump access aperture;

a pump access cover seal associated with said pump access cover to sealingly engage said pump access cover and said basin when said pump access cover is secured to said basin; and a plurality of fasteners for selectively securing said pump access cover to said basin, said pump access cover defining a largest opening in said top of said basin.

5. The wastewater sump of claim 4, wherein said pump access aperture is a circular aperture having a diameter of 10-16 inches.

6. The wastewater sump of claim 1, further comprising:

a pump access cover, said top of said basin having a pump access aperture sized to allow passage of the submersible pump, said pump access cover sized to completely cover said pump access aperture;

a pump access cover seal associated with said pump access cover to sealingly engage said pump access cover and said basin when said pump access cover is secured to said basin; and a plurality of fasteners for selectively securing said pump access cover to said basin, said pump access cover defining a largest opening in said top of said basin, said pump access aperture, said outlet and said vent aperture comprising discreet access openings through said top.

7. The wastewater sump of claim 1, further comprising:

a switch access cover, said top of said basin having a switch access aperture sized to allow passage of a float switch, said switch access cover sized and configured to selectively completely cover said switch access aperture;

a switch access cover seal associated with said switch access cover to selectively sealingly engage said switch access cover and said basin when said switch access cover is secured to said basin; and at least one fastener for selectively securing said switch access cover to said basin.

8. The wastewater sump of claim 7, wherein said recessed surface is a first recessed surface and switch access aperture is formed in a second recessed surface of said top, said switch access cover securable to said second recessed surface.

9. The wastewater sump of claim 7, further comprising:

a cord seal, said switch access cover having a cord access aperture through which at least one electric cord, said cord seal including an electric cord aperture, said cord seal operable to sealingly engage said electric cord and said switch access cover to provide a fluid tight seal therebetween; and a U-shaped handle rotatably connected to said switch access cover, said U-shaped handle having a handle base and a pair of extensions extending from said handle base, one of said pair of extensions of said U-shaped handle having a first rotated position in which said one of said pair of extensions engages said cord seal to retain said cord seal in sealing engagement with said switch access cover and said electric cord and a second rotated position in which said one of said pair of extensions disengages said cord seal.

10. The wastewater sump of claim 9, wherein said U-shaped handle comprises an E-shaped handle further comprising an intermediate extension extending from said handle base intermediate said pair of extensions, said intermediate extension having a longitudinal recess sized to rotatably receive a support secured to said switch access cover to rotatably secure said handle to said switch access cover.

11. The wastewater sump of claim 9, wherein said recessed surface is a first recessed surface and switch access aperture is formed in a second recessed surface of said top, said switch access cover securable to said second recessed surface, such that when said switch access cover is secured to said second recessed surface, said U-shaped handle is recessed from said top.

12. The wastewater sump of claim 7, wherein said sump further comprises a float switch secured to a riser extending from said switch access cover.

13. The wastewater sump of claim 7, wherein said sump further comprises a diaphragm switch, said diaphragm switch comprising:

a diaphragm housing secured to said switch access cover, whereby, with said switch access cover secured to said basin, said diaphragm housing is positioned external of said basin;

a diaphragm positioned in said diaphragm housing and hermetically sealed relative to said housing so as to divide said housing into a sensing chamber and a switching chamber, said sensing chamber hermetically sealed by said diaphragm from said switching chamber, said switching chamber fluidly connected to ambient pressure;

a switch housed in said switching chamber;

a riser pipe in fluid communication with said sensing chamber and said diaphragm, said riser pipe having an open distal end spaced from said diaphragm housing, said sensing chamber of said diaphragm housing and said riser pipe hermetically sealing said diaphragm above said open distal end of said riser pipe, such that when said switch access cover is secured to said basin, said riser pipe extends through said switch access aperture and is positioned proximate to said base, whereby the quantity of sump contents can flow into said riser pipe, and such that when the quantity of sump contents cover said open distal end of said riser pipe, the quantity of sump contents cooperate with said riser pipe and said sensing chamber of said diaphragm housing to hermetically seal a sensing side of said diaphragm accessible from said sensing chamber, the quantity of sump contents capable of filling said basin to a first height covering said open distal end of said riser pipe and a second height covering said open distal end of said riser pipe, whereby increasing the quantity of sump contents from the first height to the second height increases a pressure in the sensing chamber to actuate the diaphragm to actuate said switch.

14. The wastewater sump of claim 13, further comprising:

a second switch access cover, said second switch access cover sized and configured to selectively completely cover said switch access aperture;

a second switch access cover seal selectively associated with said second switch access cover to sealingly engage said second switch access cover and said basin when said second switch access cover is secured to said basin; and a float switch secured to a riser extending from said switch access cover;

said at least one fastener operable to selectively secure said second switch access cover to said basin, whereby said diaphragm switch and said float switch are alternatively useable with the sump.

15. The wastewater sump of claim 13, wherein said recessed surface is a first recessed surface and switch access aperture is formed in a second recessed surface of said top, said switch access cover securable to said second recessed surface, such that when said switch access cover is secured to said second recessed surface, said diaphragm housing is recessed from said top.

16. A wastewater sump, comprising:

a basin formed from:

a base;

an upstanding wall extending upwardly from said base;

a top extending inwardly from said upstanding wall, said base, said upstanding wall and said top formed of an integral, monolithic material, whereby no seams are presented between said base and said upstanding wall and no seams are presented between said upstanding wall and said top, said basin having an inlet sized to allow ingress of a quantity of sump contents in the form of at least one of a liquid and a liquid/solid mixture, and an outlet to allow egress of said quantity of sump contents, said basin sized to receive a submersible pump, a pump access cover, said top of said basin having a pump access aperture sized to allow passage of the submersible pump, said pump access cover sized to completely cover said pump access aperture;

a pump access cover seal associated with said pump access cover to sealingly engage said pump access cover and said basin when said pump access cover is secured to said basin;

a plurality of fasteners for selectively securing said pump access cover to said basin, said pump access cover defining a largest opening in said top of said basin, said top defining a sump perimeter, adjacent to a transition from said upstanding wall to said top, said pump access cover defining a pump access cover perimeter, said fasteners positionable adjacent to the pump access cover perimeter to hermetically seal said pump access cover to said basin;

wherein said basin further comprises a vent aperture formed through said top, and said upstanding wall defines an upstanding wall perimeter adjacent to said top, said top includes a recessed area, whereby said top extends from said upstanding wall perimeter transverse to said upstanding wall until reaching said recessed area, said top extending a recess distance toward said base at said recessed area to define a recess wall and further extending from the recess wall at said recess distance to form a recessed surface extending transverse to said upstanding wall, said outlet and said vent aperture formed in said recessed surface, said sump further comprising:

a vent conduit extending through said vent aperture, said vent conduit having a vent conduit external end extending externally of said basin, said vent conduit external end terminating at a distance from said recessed surface that is less than said recess distance, whereby said vent conduit external end is in said recessed area, recessed from said top of said basin and surrounded by the recess wall;

a discharge conduit extending through said outlet, said discharge conduit having a discharge conduit external end extending externally of said basin, said discharge conduit external end terminating at a distance from said recessed surface that is less than said recess distance, whereby said discharge conduit external end is in said recessed area, recessed from said top of said basin; and a shipping cover securable to the top of the basin atop the access cover, the shipping cover including a cutout sized to accommodate passage of the vent conduit and the discharge conduit through the cutout.

17. The wastewater sump of claim 16, further comprising:

a switch access cover, said top of said basin having a switch access aperture sized to allow passage of a float switch, said switch access cover sized and configured to selectively completely cover said switch access aperture;

a switch access cover seal associated with said switch access cover to selectively sealingly engage said switch access cover and said basin when said switch access cover is secured to said basin; and at least one fastener for selectively securing said switch access cover to said basin.

18. The wastewater sump of claim 17, wherein said recessed surface is a first recessed surface and switch access aperture is formed in a second recessed surface of said top, said switch access cover securable to said second recessed surface.

19. The wastewater sump of claim 17, further comprising:

a cord seal, said switch access cover having a cord access aperture through which at least one electric cord, said cord seal including an electric cord aperture, said cord seal operable to sealingly engage said electric cord and said switch access cover to provide a fluid tight seal therebetween; and a U-shaped handle rotatably connected to said switch access cover, said U-shaped handle having a handle base and a pair of extensions extending from said handle base, one of said pair of extensions of said U-shaped handle having a first rotated position in which said one of said pair of extensions engages said cord seal to retain said cord seal in sealing engagement with said switch access cover and said electric cord and a second rotated position in which said one of said pair of extensions disengages said cord seal.

20. The wastewater sump of claim 19, wherein said U-shaped handle comprises an E-shaped handle further comprising an intermediate extension extending from said handle base intermediate said pair of extensions, said intermediate extension having a longitudinal recess sized to rotatably receive a support secured to said switch access cover to rotatably secure said handle to said switch access cover.

21. The wastewater sump of claim 19, wherein said recessed surface is a first recessed surface and switch access aperture is formed in a second recessed surface of said top, said switch access cover securable to said second recessed surface, with said switch access cover secured to said second recessed surface, said U-shaped handle is recessed from said top.

22. The wastewater sump of claim 17, wherein said sump further comprises a diaphragm switch, said diaphragm switch comprising:

a diaphragm housing secured to said switch access cover, whereby, with said switch access cover secured to said basin, said diaphragm housing is positioned external of said basin;

a diaphragm positioned in said diaphragm housing and hermetically sealed relative to said housing so as to divide said housing into a sensing chamber and a switching chamber, said sensing chamber hermetically sealed by said diaphragm from said switching chamber, said switching chamber fluidly connected to ambient;

a switch housed in said switching chamber;

a riser pipe in fluid communication with said sensing chamber and said diaphragm, said riser pipe having an open distal end spaced from said diaphragm housing, said sensing chamber of said diaphragm housing and said riser pipe hermetically sealing said diaphragm above said open distal end of said riser pipe, such that when said switch access cover is secured to said basin, said riser pipe extends through said switch access aperture and positioned proximate to said base, whereby the quantity of sump contents can flow into said riser pipe, and such that when the quantity of sump contents cover said open distal end of said riser pipe, the quantity of sump contents cooperate with said riser pipe and said sensing chamber of said diaphragm housing to hermetically seal a sensing side of said diaphragm accessible from said sensing chamber, the quantity of sump contents capable of filling said basin to a first height covering said open distal end of said riser pipe and a second height covering said open distal end of said riser pipe, whereby increasing the quantity of sump contents from the first height to the second height increases a pressure in the sensing chamber to actuate the diaphragm to actuate said switch.

23. The wastewater sump of claim 22, further comprising:

a second switch access cover, said second switch access cover sized and configured to selectively completely cover said switch access aperture;

a second switch access cover seal selectively associated with said second switch access cover to sealingly engage said pump access cover and said basin when said second switch access cover is secured to said basin; and a float switch secured to a riser extending from said switch access cover;

at least one of said plurality of fasteners operable to selectively secure said second switch access cover to said basin, whereby said diaphragm switch and said float switch are alternatively useable with the sump.

24. The wastewater sump of claim 22, wherein said recessed surface is a first recessed surface and switch access aperture is formed in a second recessed surface of said top, said switch access cover securable to said second recessed surface, such that when said switch access cover is secured to said second recessed surface, said diaphragm housing is recessed from said top.

25. The wastewater sump of claim 16, wherein said sump further comprises a float switch secured to a riser extending from said switch access cover.

* * * * *